US010138093B2

(12) United States Patent
Inoue

(10) Patent No.: US 10,138,093 B2
(45) Date of Patent: Nov. 27, 2018

(54) PASSENGER CONVEYOR STEP FLOW ADJUSTING APPARATUS

(71) Applicant: MITSUBISHI ELECTRIC CORPORATION, Chiyoda-ku (JP)

(72) Inventor: Akihiko Inoue, Chiyoda-ku (JP)

(73) Assignee: MITSUBISHI ELECTRIC CORPORATION, Chiyoda-ku (JP)

( * ) Notice: Subject to any disclaimer, the term of this patent is extended or adjusted under 35 U.S.C. 154(b) by 0 days.

(21) Appl. No.: 15/564,001

(22) PCT Filed: Jun. 3, 2015

(86) PCT No.: PCT/JP2015/066052

§ 371 (c)(1),
(2) Date: Oct. 3, 2017

(87) PCT Pub. No.: WO2016/194169

PCT Pub. Date: Dec. 8, 2016

(65) Prior Publication Data

US 2018/0134522 A1 May 17, 2018

(51) Int. Cl.

| | |
|---|---|
| ***B66B 23/14*** | (2006.01) |
| ***B66B 23/00*** | (2006.01) |
| ***B66B 21/00*** | (2006.01) |
| ***B66B 21/04*** | (2006.01) |

(52) U.S. Cl.
CPC ..... *B66B 23/14* (2013.01); *B66B 21/04* (2013.01)

(58) Field of Classification Search
None
See application file for complete search history.

(56) References Cited

U.S. PATENT DOCUMENTS 4,381,851 A * 5/1983 Kraft ..... B66B 23/14 238/232
4,484,674 A * 11/1984 Lunardi ..... B66B 23/14 198/332

FOREIGN PATENT DOCUMENTS

| | | | |
|---|---|---|---|
| JP | 47-27351 | Y | 8/1972 |
| JP | 58-117464 | U | 8/1983 |
| JP | 2-6055 | Y2 | 2/1990 |
| JP | 4-80192 | A | 3/1992 |
| JP | 6-183678 | A | 7/1994 |
| JP | 8-143259 | A | 6/1996 |
| JP | 2007-39248 | A | 2/2007 |

OTHER PUBLICATIONS

International Search Report dated Aug. 18, 2015 in PCT/JP2015/066052 filed Jun. 3, 2015.

* cited by examiner

*Primary Examiner* — Kavel Singh
(74) *Attorney, Agent, or Firm* — Xsensus, LLP

(57) ABSTRACT

The passenger conveyor step flow adjusting apparatus includes: guiding pads that are disposed on two sides in a width direction of steps, and that contact facing wall surfaces of return path driving rails that are spaced apart in a width direction of a main frame, to suppress movement of the steps in the width direction; and a return path driving rail position adjusting portion that adjusts a position of each of the return path driving rails that are spaced apart in the width direction of the main frame in the width direction relative to rail supporting members.

2 Claims, 4 Drawing Sheets

PASSENGER CONVEYOR STEP FLOW ADJUSTING APPARATUS

TECHNICAL FIELD

The present invention relates to a passenger conveyor step flow adjusting apparatus such as an escalator or a moving walkway.

BACKGROUND ART

In conventional passenger conveyors, displacement of steps in a width direction has been suppressed by guiding sliding pins that protrude outward from the steps on two sides in a width direction from two sides in the width direction using a pair of return path driving rails that guide driving rollers (see Patent Literature 1, for example).

In other conventional passenger conveyors, displacement of driving rollers in a width direction has been suppressed by guiding side surfaces of the driving rollers using adjusting rails that are mounted to return path driving rails so as to be movable in the width direction (see Patent Literature 2, for example).

CITATION LIST

Patent Literature

Patent Literature 1: Japanese Patent Laid-Open No. 2007-39246 (Gazette)

Patent Literature 2: Japanese Utility Model Laid-Open No. SHO 58-117464 (Gazette)

SUMMARY OF THE INVENTION

Problem to be Solved by the Invention

In the conventional passenger conveyors, displacement of the steps in the width direction is suppressed based on the return path driving rails, but there is no mechanism for adjusting the positions of the return path driving rails in the width direction. Thus, because the displacement of the steps in the width direction is increased if the return path driving rails meander, one problem has been that noise due to contact between the steps and skirt guards on the forward path side increases, imparting discomfort to passengers. If the displacement of the steps in the width direction is great, cases may arise in which the driving rollers ride only on step sprocket wheels, and do not ride on roller presses, in an upper inverting portion. Thus, because the driving rollers must disengage from the step sprocket wheels under their own weight, one problem has been that the driving rollers are less likely to disengage from the step sprocket wheels, preventing them from shifting smoothly from the step sprocket wheels to the return path driving rails, and also increasing noise when the driving rollers disengage from the step sprocket wheels.

In the other conventional passenger conveyors, because the adjusting rails that guide the side surfaces of the driving rollers are mounted to the return path driving rails so as to be movable in the width direction, track straightness of the driving rollers is increased. However, because the adjusting rails guide the side surfaces of the driving rollers, as the driving rollers travel side surfaces thereof are placed in contact with the adjusting rails, and one problem has been that loads act on the driving rollers, damaging the driving rollers.

The present invention aims to solve the above problems and an object of the present invention is to provide a passenger conveyor step flow adjusting apparatus that suppresses displacement of steps in a width direction, to enable generation of noise due to contact between steps and skirt guards on a forward path side to be suppressed, to enable smooth transfer of driving rollers from step sprocket wheels to return path driving rails to be achieved, and also to enable the occurrence of damage to the driving rollers to be suppressed.

Means for Solving the Problem

A passenger conveyor step flow adjusting apparatus according to the present invention is a passenger conveyor step flow adjusting apparatus in which: forward path driving rails are installed in a longitudinal direction of a main frame on an upper portion side inside the main frame so as to be supported on the main frame by means of rail supporting members so as to be spaced apart in a width direction of the main frame; return path driving rails are installed in the longitudinal direction of the main frame on a lower portion side of each of the forward path driving rails that are spaced apart in the width direction of the main frame so as to be supported on the main frame by means of the rail supporting members so as to be spaced apart in a width direction of the main frame; and a plurality of steps that are linked endlessly move cyclically through the main frame such that driving rollers roll on the forward path driving rails and the return path driving rails that are spaced apart in the width direction of the main frame, the passenger conveyor step flow adjusting apparatus including: guiding pads that are disposed on two sides in a width direction of the steps, and that contact facing wall surfaces of the return path driving rails that are spaced apart in the width direction of the main frame, to suppress movement of the steps in the width direction; and a return path driving rail position adjusting portion that adjusts a position of each of the return path driving rails that are spaced apart in the width direction of the main frame in the width direction relative to the rail supporting members.

Effects of the Invention

According to the present invention, because positions of the return path driving rails in the width direction are adjusted by the return path driving rail position adjusting portions, track straightness of the return path driving rails is improved. Because the guiding pads that are disposed on two sides of the steps in the width direction contact the facing surfaces of the return path driving rails, in which track straightness is improved, to suppress movement of the steps in the width direction, displacement of the steps in the width direction is suppressed. Thus, the generation of noise that results from contact between steps and skirt guards on a forward path side can be suppressed. The occurrence of misalignments of the driving rollers relative to step sprocket wheels and roller presses in a step inverting portion is also suppressed, enabling the driving rollers to move smoothly from the step sprocket wheels to the return path driving rails. Because the driving rollers will not contact other members when rolling on the return path driving rails, situations such as loads acting on the driving rollers and damaging the driving rollers are avoided.

DESCRIPTION OF EMBODIMENTS

Embodiment 1

Figure 1:
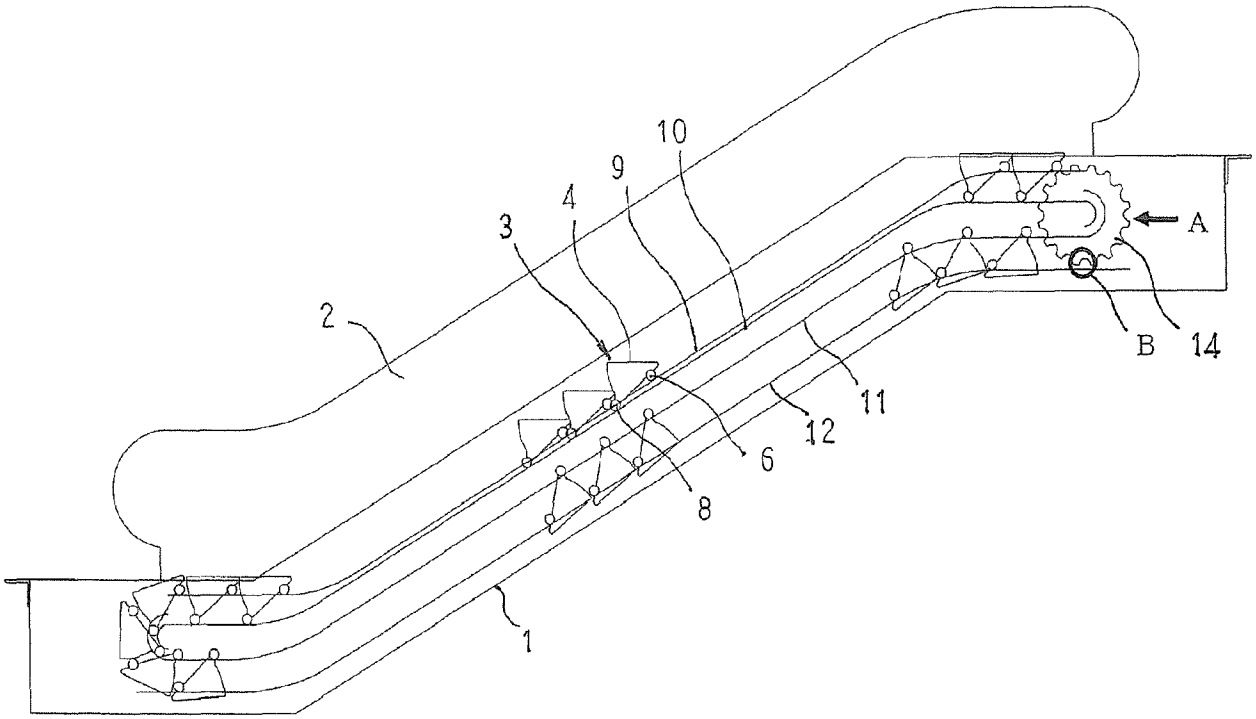
FIG. 1 is a lateral cross section that shows an escalator according to Embodiment 1 of the present invention.
Figure 2:
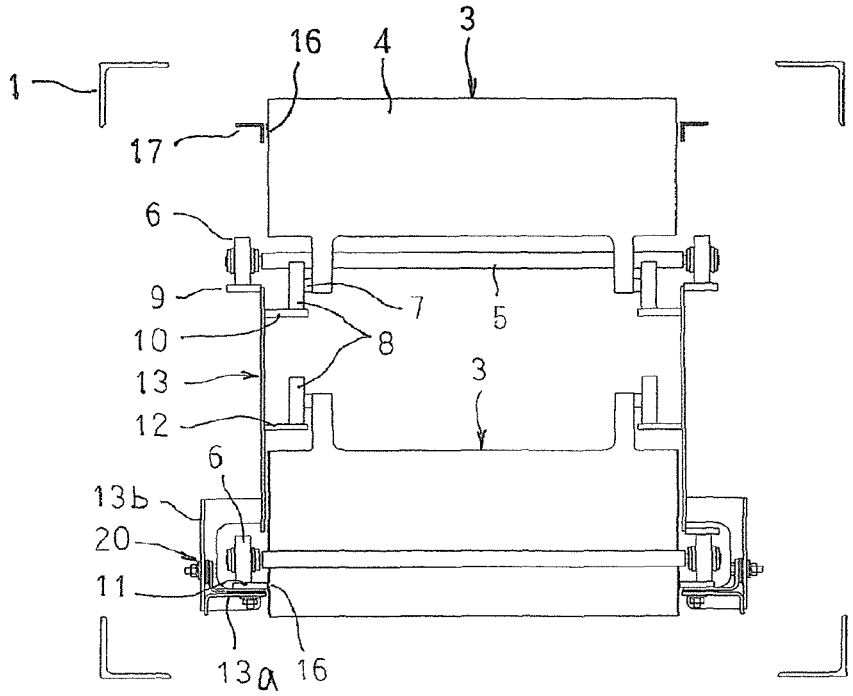
FIG. 2 is a view that shows the escalator that is shown in FIG. 1 when viewed from Direction A.
Figure 3:
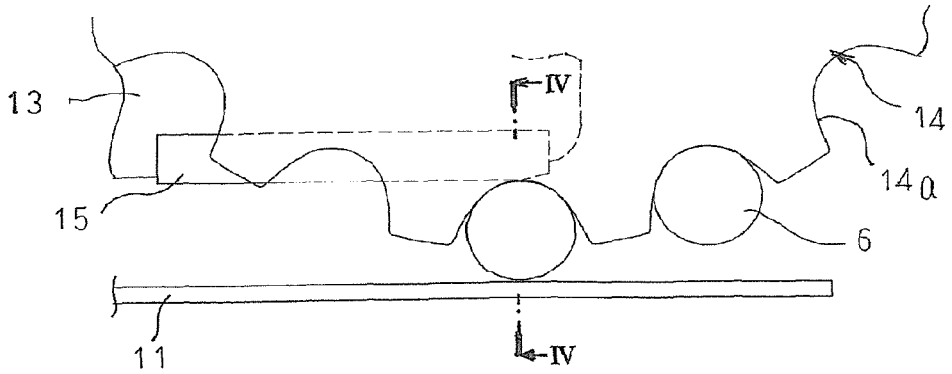
FIG. 3 is an enlargement that shows Portion B of the escalator that is shown in FIG. 1.
Figure 4:
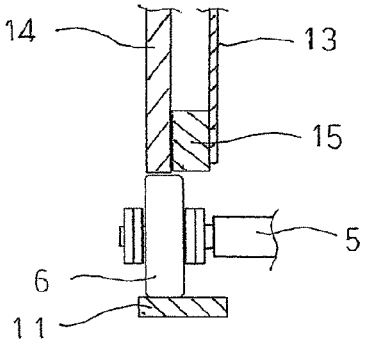
FIG. 4 is a cross section that is taken along IV-IV in FIG. 3 so as to be viewed in the direction of the arrows.
Figure 5:
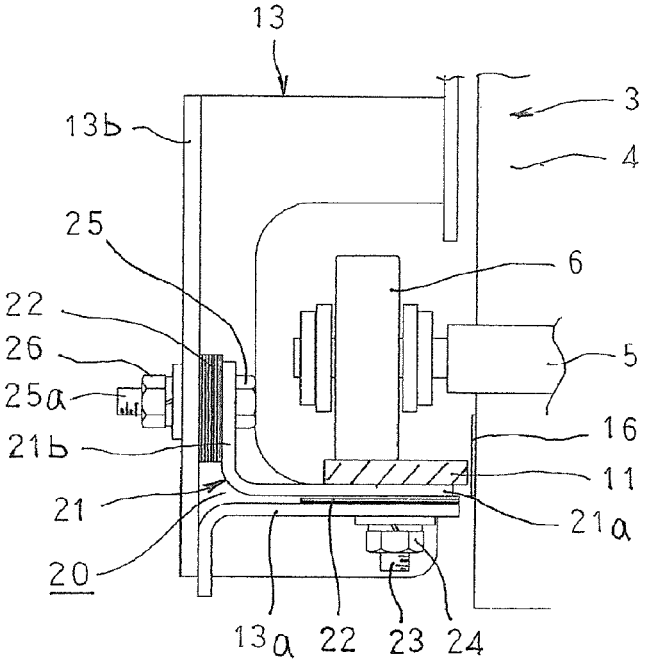
FIG. 5 is a partial front elevation that shows an escalator step flow adjusting apparatus according to Embodiment 1 of the present invention.

FIG. 1 is a lateral cross section that shows an escalator according to Embodiment 1 of the present invention, FIG. 2 is a view that shows the escalator that is shown in FIG. 1 when viewed from Direction A, FIG. 3 is an enlargement that shows Portion B of the escalator that is shown in FIG. 1, FIG. 4 is a cross section that is taken along IV-IV in FIG. 3 so as to be viewed in the direction of the arrows, and FIG. 5 is a partial front elevation that shows an escalator step flow adjusting apparatus according to Embodiment 1 of the present invention.

In FIGS. 1 and 2, a main frame 1 of an escalator that functions as a passenger conveyor is installed between an upper floor and a lower floor. A pair of railings 2 are disposed so as to stand on an upper surface of the main frame 1. Steps 3 are linked endlessly, and are disposed so as to be able to move cyclically between the pair of railings 2.

Although not shown, a motor and upper floor driving sprocket wheels that are connected to the motor by means of driving chains are disposed on an end portion of the main frame 1 in a vicinity of the upper floor. Although not shown, lower floor driving sprocket wheels are disposed on an end portion of the main frame 1 in a vicinity of the lower floor. The upper floor driving sprocket wheels and the lower floor driving sprocket wheels are both disposed on two sides of the steps 3 so as to be spaced apart in a width direction of the main frame 1. Endless step chains (not shown) that link each of the steps 3 are wound around the upper floor driving sprocket wheel and the lower floor driving sprocket wheel that are disposed on a first side in the width direction of the steps 3, and around the upper floor driving sprocket wheel and the lower floor driving sprocket wheel that are disposed on a second side in the width direction of the steps 3.

Forward path driving rails 9 that are produced into long bodies that have rectangular cross sections are installed on an upper portion side inside the main frame 1 so as to be supported on the main frame 1 by means of rail supporting members 13 so as to pass along two sides of the steps 3 and link between the upper portions of the upper driving sprocket wheels and the lower sprocket wheels. Forward path trailing rails 10 that are produced into long bodies that have rectangular cross sections are installed below the forward path driving rails 9 inside the main frame 1 so as to be supported on the main frame 1 by means of the rail supporting members 13 so as to pass along two sides of the steps 3 inside the forward path driving rails 9 in the width direction and link the upper driving sprocket wheels and the lower sprocket wheels. Return path driving rails 11 that are produced into long bodies that have rectangular cross sections are installed inside the main frame 1 so as to be supported on the main frame 1 by means of the rail supporting members 13 so as to pass below the forward path driving rails 9 so as to face each of the forward path driving rails 9 vertically and link between lower portions of the upper driving sprocket wheels and the lower sprocket wheels. Return path trailing rails 12 that are produced into long bodies that have rectangular cross sections are installed above the return path driving rails 11 inside the main frame 1 so as to be supported on the main frame 1 by means of the rail supporting members 13 so as to pass below the forward path trailing rails 10 so as to face each of the forward path trailing rails 10 vertically and link the upper driving sprocket wheels and the lower sprocket wheels.

The steps 3 include a tread 4, driving rollers 6, and trailing rollers 8, and are mounted at a uniform pitch using a pair of step chains A step shaft 5 is fixed to an end portion on the upper floor side of the tread 4 on a forward path side. Two ends of the step shaft 5 pass through the step chains. The driving rollers 6, which roll on the forward path driving rails 9 and on the return path driving rails 11, are rotatably mounted onto the two ends of the step shaft 5. The trailing rollers 8, which roll on the forward path trailing rails 10 and on the return path trailing rails 12, are rotatably mounted onto two end portions on the lower floor side of the tread 4 on the forward path side by means of a trailing shaft 7.

The step sprocket wheels 14 are disposed on an upper floor end portion of the main frame 1 so as to be spaced apart in the width direction of the main frame 1 on two sides of the treads 4 so as to be coaxial to the upper floor driving sprocket wheels so as to be able to rotate together therewith. As shown in FIGS. 3 and 4, the roller presses 15 are held by the rail supporting members 13, and are disposed on a lower portion side of the step sprocket wheels 14 inside the main frame 1 in the width direction. In addition, guiding pads 16 are mounted to two end portions of the treads 4 in the width direction such that the steps 3 contact with a skirt guard 17 that functions as a forward path guiding portion on the forward path side, and contact the return path driving rails 11 to enable displacement of the steps 3 in the width direction to be suppressed on the return path side, when the steps 3 are in motion.

In an escalator that is configured in this manner, the motor is driven, and torque from the motor is transmitted to the upper floor driving sprocket wheels by means of the driving chain, driving the upper floor driving sprocket wheels to rotate. The step chains that are wound around the upper floor driving sprocket wheels and the lower floor driving sprocket wheels are moved cyclically by this rotation of the upper floor driving sprocket wheels. The driving rollers 6 roll on the forward path driving rails 9 and on the return path driving rails 11, and the trailing rollers 8 roll on the forward path trailing rails 10 and on the return path trailing rails 12, and the steps 3 move cyclically. In an upper inverting portion that is in a vicinity of the end portion of the main frame 1 on the upper floor, the driving rollers 6 slot into grooves 14*a* of the step sprocket wheels 14, and move downward due to the rotation of the step sprocket wheels 14. As shown in FIGS. 3 and 4, when the driving rollers 6 have moved to a lower part due to the rotation of the step sprocket wheels 14, they contact the roller presses 15, disengage from the grooves 14*a* of the step sprocket wheels 14, and ride on the return path driving rails 11. The inverting operation of the steps 3 at the upper inverting portion is thereby performed smoothly. Thus, the generation of noise is suppressed when the driving rollers 6 disengage from the grooves 14*a* of the step sprocket wheels 14.

Next, a step flow adjusting apparatus 20 will be explained with reference to FIGS. 2 and 5.

The rail supporting members 13 include: driving rail supporting arms 13*a* that are positioned below the return path driving rails 11, and that support the return path driving rails 11; and mounting arms 13*b* that face the steps 3 from opposite sides of the return path driving rails 11. Although not shown, first guiding apertures that are elongated in the width direction of the main frame 1 are formed on the driving rail supporting arms 13*a*, and vertically elongated second guiding apertures are formed on the mounting arms 13*b*.

The step flow adjusting apparatus 20 includes: guiding pads 16 that are disposed on two sides in the width direction of the treads 4, and return path driving rail position adjusting portions that adjust the positions of the return path driving rails 11 in the width direction relative to the rail supporting members 13. The return path driving rail position adjusting portions include: brackets 21 that are produced so as to have an L shape; liners 22 that adjust the width direction positions and the vertical positions of the brackets 21; screw-threaded rods 23 and nuts 24 that fasten first sides 21*a* of the L shapes of the brackets 21 that function as rail supporting portions onto the driving rail supporting arms 13*a*; and bolts 25 and nuts 26 that function as fastening members that fasten second sides 21*b* of the L shapes of the brackets 21 that function as mounting portions to the mounting arms 13*b*.

Upper surfaces in a vicinity of tips of the first sides 21*a* of the L shapes of the brackets 21 are fixed by welding, etc., to lower surfaces of the return path driving rails 11, and the screw-threaded rods 23 are fixed by welding, etc., and are disposed so as to stand on lower surfaces of the first sides 21*a* of the L shapes. The brackets 21 are mounted to the driving rail supporting arms 13*a* by passing the screw-threaded rods 23 through the first guiding apertures that are formed on the driving rail supporting arms 13*a*, and fastening the nuts 24, which are screwed onto portions of the screw-threaded rod 23 that protrude from the first guiding apertures. The second sides 21*b* of the L shapes of the brackets 21 are mounted to the mounting arms 13*b* by fastening the nuts 26, which are screwed onto shaft portions 25*a* of the bolts 25, which are passed through the second guiding apertures that are formed on the mounting arms 13*b*.

In a return path driving rail position adjusting portions that is configured in this manner, the screw-threaded rods 23 become movable in the width direction of the main frame 1 so as to be guided by the first guiding apertures by loosening the nuts 24. Thus, the positions of the return path driving rails 11 in the width direction of the main frame 1 can be adjusted by loosening the nuts 26, and changing the number of liners 22 that are inserted between the second sides 21*b* of the L shapes of the brackets 21 and the mounting arms 13*b*. The bolts 25 also become movable vertically so as to be guided by the second guiding apertures by loosening the nuts 26. Thus, the height positions of the return path driving rails 11 can be adjusted by loosening the nuts 24, and changing the number of liners 22 that are inserted between the first sides 21*a* of the L shapes of the brackets 21 and the driving rail supporting arms 13*a*.

In the step flow adjusting apparatus 20 according to Embodiment 1, because the positions of the return path driving rails 11 in the width direction of the main frame 1 can be adjusted by changing the number of width direction position adjusting liners 22 that are sandwiched between the second sides 21*b* of the brackets 21 and the mounting arms 13*b*, track straightness of the return path driving rails 11 is improved. Because displacement of the steps 3 in the width direction is suppressed by the guiding pads 16 contacting the return path driving rails 11, in which the track straightness is increased, the generation of noise due to contact between the steps 3 and the skirt guards 17 on the forward path side is suppressed.

Because the displacement of the steps 3 is suppressed in the width direction, the driving rollers 6 are positionally adjusted so as to span the step sprocket wheels 14 and the roller presses 15 in the upper inverting portion. Thus, the driving rollers 6 reliably contact the roller presses 15, are disengaged from the grooves 14*a* of the step sprocket wheels 14, and can transfer to the return path driving rails 11 smoothly, enabling the generation of noise when the driving rollers 6 are disengaged from the grooves 14*a* to be suppressed.

Because the height positions of the return path driving rails 11 can be adjusted by loosening the nuts 24, and changing the number of vertical position adjusting liners 22 that are sandwiched between the first sides 21*a* of the brackets 21 and the driving rail supporting arms 13*a*, track flatness of the return path driving rails 11 is increased, enabling the driving rollers 6 to roll smoothly on the return path driving rails 11, and suppressing the generation of noise.

In addition, because the driving rollers 6 roll on the return path driving rails 11 without contacting other parts, excessive loads will not act on the driving rollers 6, enabling the occurrence of damage to the driving rollers 6 to be suppressed.

Embodiment 2

Figure 6:
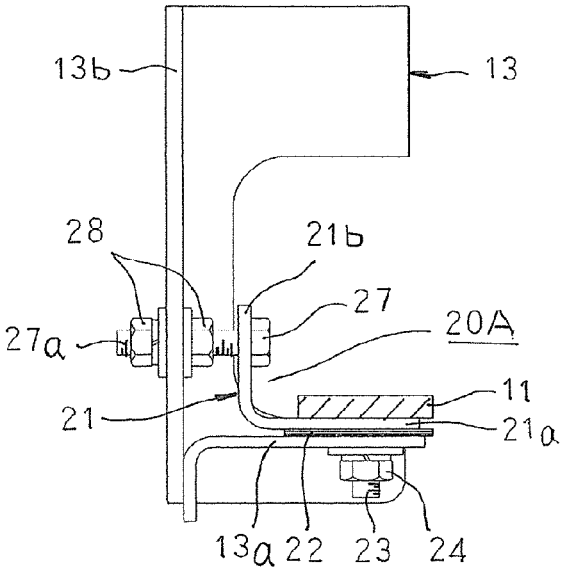
FIG. 6 is a partial front elevation that shows an escalator step flow adjusting apparatus according to Embodiment 2 of the present invention.

FIG. 6 is a partial front elevation that shows an escalator step flow adjusting apparatus according to Embodiment 2 of the present invention.

In FIG. 6, a position adjusting bolt 27 is fixed to a second side 21*b* of a bracket 21 by being fastened into an internal screw thread portion (not shown) that is formed on the second side 21*b*. The bracket 21 is mounted to a mounting arm 13*b* by passing a shaft portion 27*a* of the position adjusting bolt 27 through a second guiding aperture on the mounting arm 13*b*, and fastening a pair of nuts 28 that are screwed onto the shaft portions 27*a* from an opposite side of the mounting arm 13*b*.

In a step flow adjusting apparatus 20A according to Embodiment 2, the brackets 21 can be moved in a width direction of a main frame 1 by loosening first nuts 28, and turning second nuts 28 in a fastening direction. The positions of the return path driving rails in the width direction 11 are adjusted by moving the return path driving rails 11, which are fixed to the first sides 21*a* in the width direction of the main frame 1, together with the movement of the brackets 21. Then, after adjusting the positions of the return path driving rails 11 in the width direction, the return path driving rails 11 are fixed in the adjusted positions in the width direction by fastening the first nuts 28. The height positions of the return path driving rails 11 can be adjusted by changing the number of vertical position adjusting liners 22 that are sandwiched between the first sides 21*a* of the brackets 21 and the driving rail supporting arms 13*a*.

Consequently, similar or identical effects to those of Embodiment 1 can also be achieved in Embodiment 2.

According to Embodiment 2, width direction position adjusting liners 22 are no longer required, enabling the number of parts to be reduced.

Because the positions of the return path driving rails 11 in the width direction can be prescribed by positions of the nuts 28, the positions of the return path driving rails 11 in the width direction can be adjusted with high precision.

Moreover, in Embodiment 2 above, the position adjusting bolts 27 are fixed to the second sides 21*b* of the brackets 21 using internal screw thread portions that are formed on the second sides 21*b*, but the position adjusting bolts 27 may be fixed on the second sides 21*b* by forming penetrating apertures on the second sides 21*b* and fastening nuts that are screwed onto the shaft portions 27*a* of the position adjusting bolts 27 that protrude outward from the penetrating apertures. In addition, screw-threaded rods may be disposed so as to stand on surfaces of the second sides 21*b* near the mounting arms 13*b* so as to be fixed by welding, etc., instead of the position adjusting bolts 27.

Embodiment 3

Figure 7:
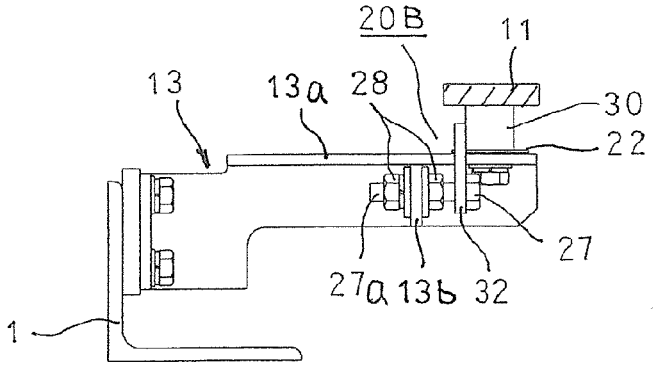
FIG. 7 is a partial front elevation that shows an escalator step flow adjusting apparatus according to Embodiment 3 of the present invention.

FIG. 7 is a partial front elevation that shows an escalator step flow adjusting apparatus according to Embodiment 3 of the present invention.

In FIG. 7, a rail supporting block 30 is fixed to a lower surface of a return path driving rail 11 by welding, etc. The rail supporting block 30 is fixed to a driving rail supporting arm 13*a* by fastening a mounting bolt 31 that is passed through a first guiding aperture of the driving rail supporting arm 13*a* from below into an internal screw thread portion (not shown) that is formed on a lower surface of the rail supporting block 30. A mounting plate 32 is fixed to the rail supporting block 30 by a first end so as to extend downward. A position adjusting bolt 27 is fixed to the mounting plate 32 by being fastened into an internal screw thread portion (not shown) that is formed on the mounting plate 32. The mounting plate 32 is mounted to a mounting arm 13*b* by passing a shaft portion 27*a* of the position adjusting bolt 27 through a second guiding aperture on the mounting arm 13*b*, and fastening a pair of nuts 28 that are screwed onto the shaft portions 27*a* from an opposite side of the mounting arm 13*b*.

In a step flow adjusting apparatus 20B according to Embodiment 3, the rail supporting blocks 30 can be moved in a width direction of a main frame 1 by loosening first nuts 28, and turning second nuts 28 in a fastening direction. The positions of the return path driving rails in the width direction 11 are adjusted by moving the return path driving rails 11 in the width direction of the main frame 1, together with the movement of the rail supporting blocks 30. Then, after adjusting the positions of the return path driving rails 11 in the width direction, the return path driving rails 11 are fixed in the adjusted positions in the width direction by fastening the first nuts 28. The height positions of the return path driving rails 11 can be adjusted by changing the number of vertical position adjusting liners 22 that are sandwiched between the first sides 21*a* of the rail supporting blocks 30 and the driving rail supporting arms 13*a*.

Consequently, similar or identical effects to those of Embodiment 1 can also be achieved in Embodiment 3.

According to Embodiment 3, width direction position adjusting liners 22 are no longer required, enabling the number of parts to be reduced.

Because the positions of the return path driving rails 11 in the width direction can be prescribed by positions of the nuts 28, the positions of the return path driving rails 11 in the width direction can be adjusted with high precision.

Moreover, in Embodiment 3 above, the position adjusting bolts 27 are fixed to the mounting plates 32 using internal screw thread portions that are formed on the mounting plates 32, but the position adjusting bolts 27 may be fixed on the mounting plates 32 by forming penetrating apertures on the mounting plates 32 and fastening nuts that are screwed onto the shaft portions 27*a* of the position adjusting bolts 27 that protrude outward from the penetrating apertures. In addition, screw-threaded rods may be disposed so as to stand on surfaces of the mounting plates 32 near the mounting arms 13*b* so as to be fixed by welding, etc., instead of the position adjusting bolts 27.

In Embodiment 3 above, the rail supporting blocks 30 are fixed by fastening to the driving rail supporting arms 13*a* using internal screw thread portions that are formed on the lower surfaces of the rail supporting blocks 30, but the rail supporting blocks 30 may be mounted to the driving rail supporting arms 13*a* by passing screw-threaded rods that are disposed so as to stand on the lower surfaces of the rail supporting blocks 30 by welding, etc., through the first guiding apertures of the driving rail supporting arms 13*a*, and fastening nuts that are screwed onto portions of the screw-threaded rods that protrude from the first guiding apertures.

In each of the above embodiments, a case that is applied to an escalator has been explained, but similar or identical effects can also be achieved if applied to a moving walkway.

The invention claimed is:

1. A passenger conveyor step flow adjusting apparatus in which:

forward path driving rails are installed in a longitudinal direction of a main frame on an upper portion side inside said main frame so as to be supported on said main frame by means of rail supporting members so as to be spaced apart in a width direction of said main frame;

return path driving rails are installed in said longitudinal direction of said main frame on a lower portion side of each of said forward path driving rails that are spaced apart in said width direction of said main frame so as to be supported on said main frame by means of said rail supporting members so as to be spaced apart in a width direction of said main frame; and a plurality of steps that are linked endlessly move cyclically through said main frame such that driving rollers roll on said forward path driving rails and said return path driving rails that are spaced apart in said width direction of said main frame, wherein said passenger conveyor step flow adjusting apparatus comprises:

guiding pads that are disposed on two sides in a width direction of said steps, and that contact facing wall surfaces of said return path driving rails that are spaced apart in said width direction of said main frame, to suppress movement of said steps in said width direction; and a return path driving rail position adjusting portion that adjusts a position of each of said return path driving rails that are spaced apart in said width direction of said main frame in said width direction relative to said rail supporting members, wherein said return path driving rail position adjusting portion comprises:

a rail supporting block that is fixed to a lower surface of said return path driving rails;

a mounting plate that extends downward from said rail supporting block:

a position adjusting bolt that is fixed to said mounting plate; and a pair of nuts that are screwed on an opposite side from said rail supporting member onto a shaft portion of said position adjusting bolt that passes through said rail supporting member, and that fix said mounting plate to said rail supporting member by fastening.

2. The passenger conveyor step flow adjusting apparatus according to claim 1, wherein:

said mounting plate is fastened to said rail supporting member by said position adjusting bolt and said pair of nuts so as to be movable vertically;

said rail supporting block is fastened to said rail supporting member so as to be movable in said width direction of said main frame; and a vertical position adjusting liner is disposed between said rail supporting block and said rail supporting member.

* * * * *